US007969371B2

(12) United States Patent
Yun et al.

(10) Patent No.: US 7,969,371 B2
(45) Date of Patent: Jun. 28, 2011

(54) SMALL MONOPOLE ANTENNA HAVING LOOP ELEMENT INCLUDED FEEDER

(75) Inventors: Je-Hoon Yun, Daejon (KR); Jung-Ick Moon, Daejon (KR); Joung-Myoun Kim, Daejon (KR); Chang-Joo Kim, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 229 days.

(21) Appl. No.: 11/996,451

(22) PCT Filed: Jul. 21, 2006

(86) PCT No.: PCT/KR2006/002887

§ 371 (c)(1),
(2), (4) Date: Feb. 24, 2009

(87) PCT Pub. No.: WO2007/011191

PCT Pub. Date: Jan. 25, 2007

(65) Prior Publication Data

US 2009/0322633 A1 Dec. 31, 2009

(30) Foreign Application Priority Data

Jul. 22, 2005 (KR) ..... 10-2005-0066911
Oct. 10, 2005 (KR) ..... 10-2005-0094942

(51) Int. Cl.
*H01Q 11/12* (2006.01)
*H01Q 1/24* (2006.01)

(52) U.S. Cl. ..... 343/741; 343/866; 343/702

(58) Field of Classification Search ..... 343/741, 343/742, 702, 866, 867
See application file for complete search history.

(56) References Cited

U.S. PATENT DOCUMENTS

| | | | | |
|---|---|---|---|---|
| 2006/0114159 | A1* | 6/2006 | Yoshikawa et al. | 343/702 |
| 2009/0015512 | A1* | 1/2009 | Hao | 343/895 |
| 2009/0073048 | A1* | 3/2009 | Kim | 343/700 MS |
| 2009/0273530 | A1* | 11/2009 | Chi et al. | 343/741 |

FOREIGN PATENT DOCUMENTS

| | | | |
|---|---|---|---|
| KR | 1997-7001935 | | 4/1997 |
| KR | 2003-0008902 | A | 1/2003 |
| KR | 2004-0019295 | | 3/2004 |
| KR | 2004-0100057 | A | 12/2004 |
| KR | 2005-0041032 | | 5/2005 |
| WO | WO-00/39894 | | 7/2000 |
| WO | WO-2004/025778 | | 3/2004 |

OTHER PUBLICATIONS

Jung, Jong-Ho et al., Electromagnetically Coupled Small Broadband Monopole Antenna, IEEE Antennas and Wireless Propagation Letters, vol. 2, pp. 349-351, 2003.

* cited by examiner

*Primary Examiner* — HoangAnh T Le
(74) *Attorney, Agent, or Firm* — Rabin & Berdo, P.C.

(57) ABSTRACT

Provided is a small monopole antenna having a loop feeder. The small monopole antenna having a loop feeder includes: a loop element forming a loop along a predetermined plane and having a loop feeder at the center thereof; a non-feeding type monopole antenna element including one end connected to a wire of the loop element and other end connected to a ground unit by being bended at the center of the loop element; a ground unit for grounding other end of the non-feeding type monopole antenna; and a first connecting unit for connecting the non-feeding type monopole antenna to an external device for feeding the loop feeder of the loop element through the non-feeding type monopole antenna.

24 Claims, 14 Drawing Sheets

SMALL MONOPOLE ANTENNA HAVING LOOP ELEMENT INCLUDED FEEDER

TECHNICAL FIELD

The present invention relates to a small monopole antenna having a loop feeder; and more particularly, to a small monopole antenna having a loop feeder for reducing a size of the antenna by lengthening an electrical length of an antenna by placing a feeder at a center of a loop element and for maintaining omni-directional radiation pattern characteristic of a vertically polarized wave in order to simultaneously transmit/receive a wireless signal at anywhere.

BACKGROUND ART

In the present invention, a term "wire" denotes not only a wire itself but also a cable.

In order to develop an antenna for a portable phone for receiving data of mobile communication and digital multimedia broadcasting (DMB), various antenna technologies have been introduced such as technologies for high efficiency, low loss, omni-directional radiation pattern, impedance matching for improving a radiation efficiency, a broad bandwidth characteristic, a low power consumption, for reducing the size and width of the antenna, and for simplifying a design, for protecting human from harmful radiated electromagnetic waves, for an electromagnetic environment and for improving portability.

Among technologies, the technology for making the antenna smaller and light-weighted is a technology for improving the portability and has been receiving attention in an antenna field for a mobile communication terminal such as a cellular phone, a personal communication station (PCS) phone and a global system for mobile communication (GSM) phone and a DMB phone for receiving data of digital multimedia broadcasting (DMB).

Especially, an antenna for receiving data of digital multimedia broadcasting (DMB) is generally very large. For example, a length of an antenna for Korea DMB data which is broadcasted at 200 MHz band is about 37 cm. Therefore, the large antenna makes a user inconvenient to carry with a portable phone putted in a pocket and makes the appearance of the portable phone detracted. Furthermore, the large antenna makes a manufacturing process thereof complicated. Therefore, demands of a small monopole antenna have increased.

As conventional antennas for a portable phone, a whip antenna, a helical antenna, a slave antenna, an inverted-F antenna, a planar inverted-F antenna, a diversity antenna, a microstrip antenna, a chip antenna, a twisted loop antenna, a EID antenna, a N-type antenna were introduced. They may be classified into a monopole antenna group and other groups according to a method of exciting an electromagnetic field.

The monopole antenna denotes an antenna having a sufficient size of a ground plane and using image effects of the opposite side of the ground plane. The monopole antenna generally has an external structure to have a length of ¼ wavelength as like as a whip antenna, a helical antenna, a slave antenna and an N-type antenna. In order to reduce the size of the monopole antenna, a disk shaped top load is added at the end of the antenna, the monopole antenna is twisted as a meander type, or the monopole antenna is twisted as like as a helical antenna. However, there is a limitation to reduce the size of the monopole antenna smaller than a 1/10 wavelength through the conventional technologies.

On the contrary, an inverted-F antenna, a planar inverted-F antenna, a diversity antenna, a microstrip antenna, an EID antenna, a full short circuit planar inverted F antenna (FS-PIFA) and a radiation coupled dual-L antenna were introduced as other types of antennas for a portable phone. The planar inverted-F antenna, the microstrip patch antenna, a dielectric antenna are manufactured as a small internal antenna. In order to reduce the size thereof while lengthening the electric length thereof, a dielectric may be used or the antenna is bended or deformed to have a predetermined shape. However, it is very difficult to reduce a size of an antenna smaller than a 1/10 wavelength. It is also difficult to maintain an omni-directional radiation pattern of a vertical polarized wave because such antennas are disposed in a portable phone vertically coupled to a printed circuit board (PCB).

Furthermore, a method of manufacturing a small internal antenna having a long electric length by disposing a dielectric block inside a main body of a portable phone and using more than two sides of the dielectric block was introduced in a Korea Patent Application No. 10-2003-0032258. However, the method introduced in Korean Patent Application No. 10-2003-0032258 also has the same problems described above.

Recently, a small monopole antenna having a size smaller than a 1/10 wavelength was introduced. In order to reduce the size of the antenna, an inductance element such as a helical antenna is added at a disk monopole antenna. Although such a monopole antenna maintains broadband characteristics, the monopole antenna has a complicated structure and it is difficult to dispose the monopole antenna in a limited space such as an inside space of a portable phone. Furthermore, a conventional technology of miniaturizing an antenna by adding a gap capacitor at a feeder of a loop antenna was introduced. However, the conventional antenna has a narrowband characteristic and has difficulty to maintain an omni-directional radiation pattern which is commonly required for various types of portable phones.

DISCLOSURE

Technical Problem

It is, therefore, an object of the present invention to provide a small monopole antenna having a loop feeder for reducing a size thereof by further lengthening an electric length of an antenna by placing a loop element at a center of a feeder, and for maintaining omni-directional radiation pattern characteristic of a vertical polarized wave to simultaneously receive/transmit a wireless signal.

Technical Solution

In accordance with one aspect of the present invention, there is provided a small monopole antenna having a loop feeder including: a loop element forming a loop along a predetermined plane and having a loop feeder at the center thereof; a non-feeding type monopole antenna element including one end connected to a wire of the loop element and other end connected to a ground unit by being bended at the center of the loop element; a ground unit for grounding other end of the non-feeding type monopole antenna; and a first connecting unit for connecting the non-feeding type monopole antenna to an external device for feeding the loop feeder of the loop element through the non-feeding type monopole antenna.

Advantageous Effects

In a small monopole antenna having a loop feeder according to the present invention, the loop feeder is placed at a center of a loop element to lengthen an electric length of the antenna for reducing a size thereof and to maintain an omni-directional radiation pattern of a vertical polarized wave for simultaneously transmitting and receiving a wireless signal at anywhere. Therefore, the usability of inside space of a portable phone is improved.

Also, the small monopole antenna having a loop feeder according to the present invention is easy to be manufactured and has a simple tuning method. Therefore, the manufacturing cost can be reduced by reducing the time for manufacturing the antenna. Also, the appearance of the portable phone is improved.

Since the small monopole antenna having a loop feeder is very small, it is possible to dispose an excitation region of a radiated electric field to be far away from the head of the user. Also, it is possible to reduce SAR because the small monopole antenna has a structure easy to include an electromagnetic field absorbing member. Furthermore, it is possible to embody an antenna to provide various wireless services because the small monopole antenna has a structure that can be used with a helical antenna and a whips antenna.

DESCRIPTION OF DRAWINGS

The above and other objects and features of the present invention will become apparent from the following description of the preferred embodiments given in conjunction with the accompanying drawings, in which.

BEST MODE FOR THE INVENTION

Other objects and aspects of the invention will become apparent from the following description of the embodiments with reference to the accompanying drawings, which is set forth hereinafter.

Figure 1:
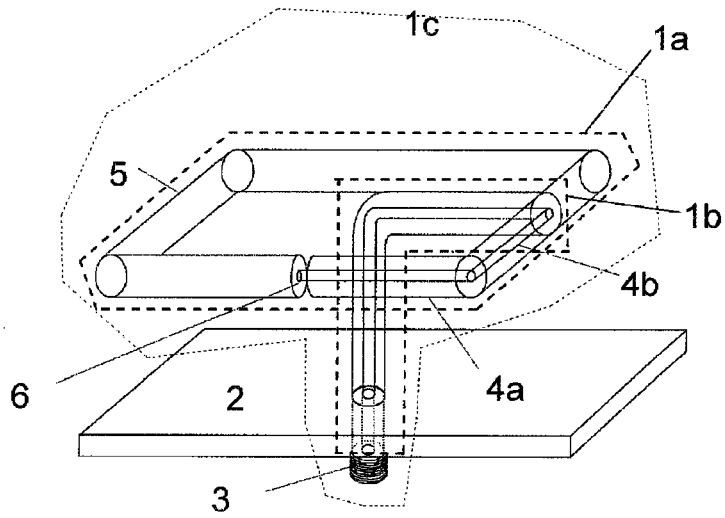
FIGS. 1 and 2 are views illustrating a small monopole antenna having a loop feeder vertically connected to a ground plane and a small monopole antenna having a loop feeder coupled to a ground plane in a L shape in accordance with a preferred embodiment of the present invention.
Figure 2:
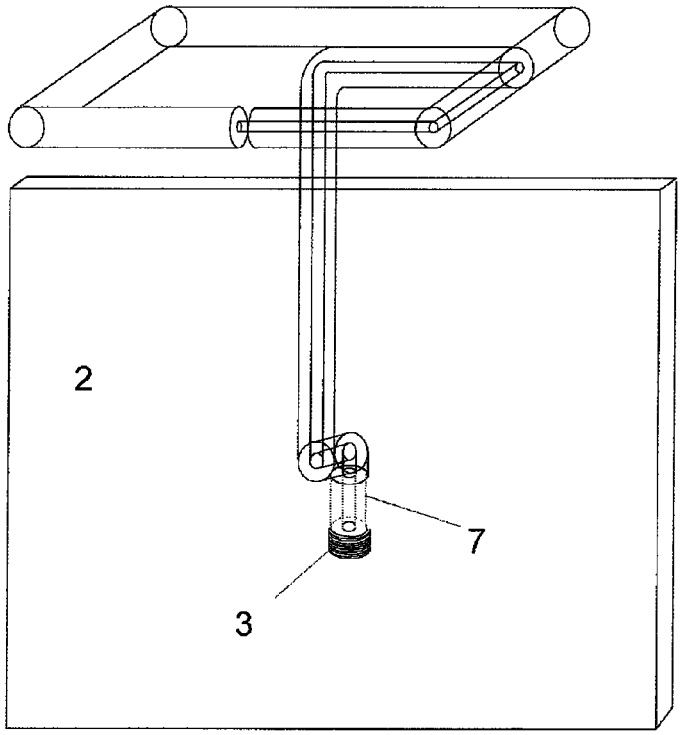

FIGS. 1 and 2 are views illustrating a small monopole antenna having a loop feeder vertically connected to a ground plate and a small monopole antenna having a loop feeder coupled to a ground plate in an L shape in accordance with a preferred embodiment of the present invention.

As shown in FIG. 1, the small monopole antenna having a loop feeder vertically connected to a ground plate or a printed circuit board (PCB) according to the present embodiment, which is called as a small monopole antenna having a vertical coupling type loop feeder, includes a loop element 1A, a non-feeding type monopole antenna element 1B, a ground plate 2, a connector 3, a conductive wire 5 and a loop feeder 6.

The small monopole antenna the small monopole antenna having the vertical coupling type loop feeder according to the present embodiment is embodied by connecting the non-feeding type monopole antenna element 2 disposed on the ground plate 2 to the loop element 1A. The loop element 1A is formed as a circular shape or a rectangular shape along a horizontal plane, and a predetermined part of the loop element 1A is embodied as wires or cables 4A and 4B. The non-feeding type monopole antenna element 1B is connected to the wire or the cable 4A and 4B. The non-feeding type monopole antenna element 1B is placed at the same horizontal plane of the loop element 1A and is connected to the ground plate 2 by being bended at the center thereof. Herein, the loop feeder 6 must be placed at the loop element 1A. By placing the loop feeder 6 at the loop element 1A, the electric length of the wire is further lengthened. Therefore, the small monopole antenna according to the present invention can have the target characteristics although it has a small size. The loop element 1A may be formed of a feeding cable itself or a pipe with a coaxial cable passed through in order to feed power to the loop element 1A. Also, power is fed to the loop feeder 6 through the connector 3 and the non-feeding monopole antenna element 1B.

Figure 4:
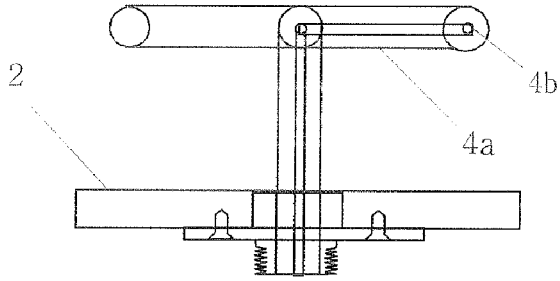

The small monopole antenna according to the present embodiment may be divided into two main parts, an antenna unit 1*c* and a ground plate 2. In the antenna unit 1C, the cable composed of an external conductive 4A and an internal conductive 4B is arranged from the connector 3 to the loop feeder 6 as a one part of the loop element 1A, and a wire 5 is disposed to form a loop by connecting one end of the wire 5 to the internal conductive 4B and connecting other end of the wire 5 to the external conductive 4A as the remained part of the loop element 1A. As a result, a monopole antenna form having a loop feeder is formed. Therefore, the small monopole antenna according to the present invention has an omni-directional radiation characteristic of a vertical polarized wave in a radiated electromagnetic field characteristics as like as a monopole antenna as shown in FIG. 4.

As shown in FIG. 2, the small monopole antenna includes a loop feeder connected to the ground plate in an L shape in parallel to the ground plate 2, which is called as the small monopole antenna having an L coupling type loop feeder. The structure of the small monopole antenna having the L coupling type loop feeder is similar to the small monopole antenna having the vertical coupling type loop feeder of FIG. 1. That is, the small monopole antenna having the L coupling type loop feeder includes a loop element 1A and an non-feeding type monopole antenna element 1B connecting the loop element 1A to the ground plate 2, where the loop element 1A composed of a cable 4A and 4B, a wire and a loop feeder 6. The cable is sealed in the non-feeding monopole antenna element 1B to be passed through the non-feeding monopole antenna element 1B. As shown in FIG. 2, an external conductive coupling member 7, which is a part of the external conductive 4A, is disposed in parallel from the ground plate 2. A connector 3 is projected from a center or a corner of the ground plate 2 and connected to the external conductive coupling member 7.

That is, the small monopole antenna having the L coupling type loop feeder according to the present invention has a structure suitable to a printed circuit board (PCB) of a general portable electronic equipment such as a mobile communication terminal, a personal data assistant (PDA), a digital multimedia broadcasting (DMB) phone and a notebook computer.

As shown in FIGS. 1 and 2, the small monopole antenna having the vertical coupling type feeder and the small monopole antenna having the L coupling type feeder according to the present embodiment have the loop plane of the loop element 1A that is formed in parallel or vertical to the ground plate 2. However, the characteristics of the present invention can be satisfied if the angle between the ground plate 2 and the loop plane of the loop element 1A is in a range of −45° to 45° from a horizontal plane or a vertical plane.

Also, the electrical length of the small monopole antenna according to the present invention can be lengthened with the size of the small monopole antenna maintained by disposing a metal plate or one or more wires between the ground plate 2 and the non-feeding type monopole antenna element 1B. In this case, the small monopole antenna according to the present embodiment can have the broadband characteristics.

Furthermore, the small monopole antenna having the loop feeder according to the present invention can have the broadband characteristics by forming the non-feeding type monopole antenna element 1B thicker than the loop element 1A or by forming the wire or the cable of the non-feeding type monopole antenna element 1*b* as a meander type or a helical type.

Figure 3:
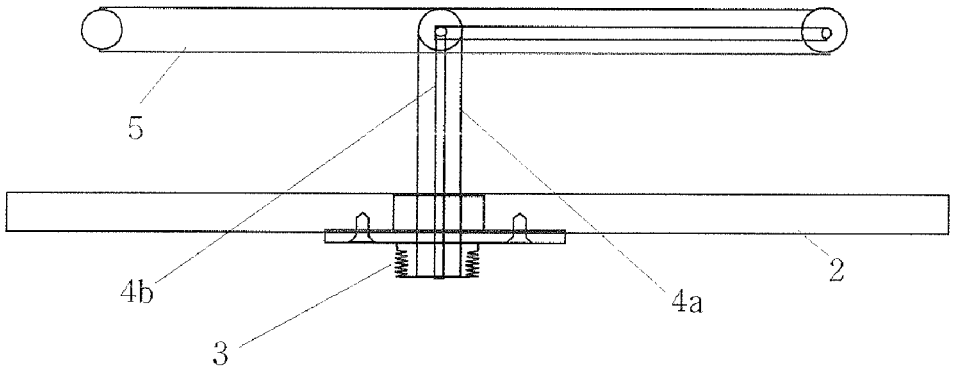
FIGS. 3 to 5 are a front cross sectional view, a side cross sectional view and a plan view of a small monopole antenna having a vertical coupling type loop feeder in accordance with a preferred embodiment of the present invention.
Figure 5:
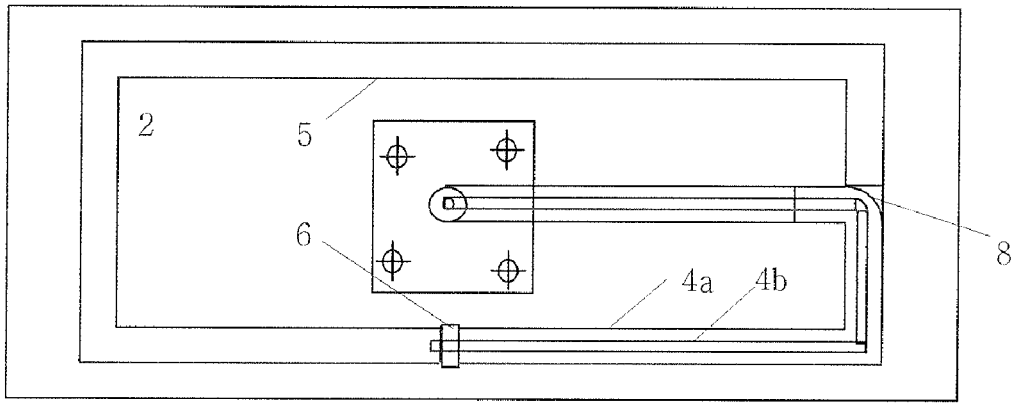

FIGS. 3 to 5 are a front cross sectional view, a side cross sectional view and a plan view of a small monopole antenna having a vertical coupling type loop feeder in accordance with a preferred embodiment of the present invention.

FIG. 3 is a front cross sectional view a small monopole antenna having a vertical coupling type loop feeder in accordance with a preferred embodiment of the present invention, FIG. 4 is a side cross sectional view, and FIG. 5 is a plan view of a small monopole antenna having a vertical coupling type loop feeder in accordance with a preferred embodiment of the present invention.

FIGS. 3 to 5 clearly show that the cable composed of the external conductive 4A and the internal conductive 4B is connected to the loop feeder 6 of the loop element 1A that is disposed at an upper portion of the antenna through the connecting member 3. Although the small monopole antenna has a structure disposing the cable inside a metal pipe, the overall characteristics of the small monopole antenna according to the present invention is not influenced thereby. As shown, the conductive wire 5 is connected to the external conductive 4A at a predetermined position 8 where the cable is bended in the loop element 1A.

Figure 6:
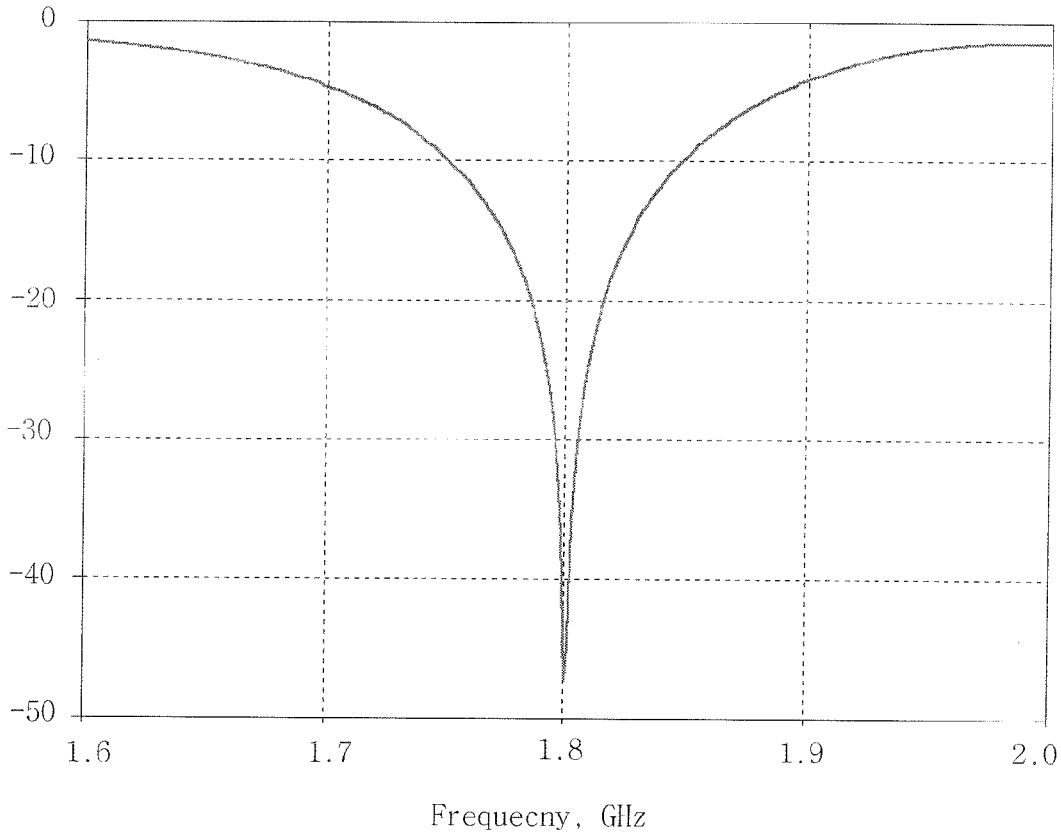
FIG. 6 is a graph showing a S11 parameter of a small monopole antenna having a vertical coupling type loop feeder in accordance with a preferred embodiment of the present invention.

FIG. 6 is a graph showing a S11 parameter of a small monopole antenna having a vertical coupling type loop feeder in accordance with a preferred embodiment of the present invention.

The graph of FIG. 6 shows the S11 parameter characteristics of the small monopole antenna having the loop feeder vertically coupled to the ground plate according to the present invention that has a 0.8 cm of height, a 0.7 cm of a width, and a 2.4 cm of a length with a 0.2 cm of thickness. As shown in FIG. 6, about 100 MHz is maintained at less than −10 dB, and a resonance is generated at 1.8 MHz. The graph shows that the height of the antenna is 1/20 wavelength, the width is about 1/23 wavelength and the length is about 1/7 wavelength. As shown, a small antenna can be manufactured according to the present invention.

Figure 7:
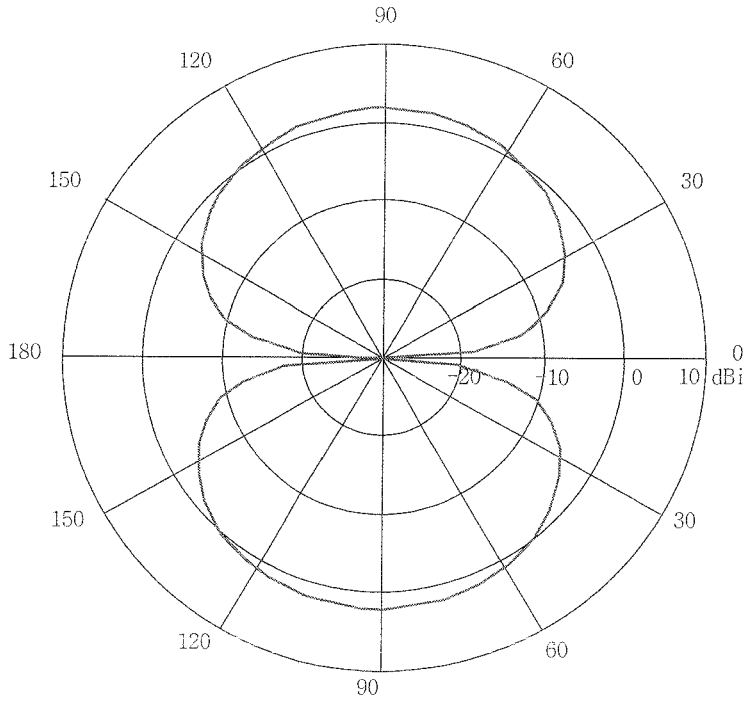
FIGS. 7 and 8 show an electric field pattern of a horizontally polarized wave according to variation of wave angle and azimuth of a small monopole antenna having a loop feeder vertically coupled to a ground plate or PCB in accordance with a preferred embodiment of the present invention.
Figure 8:
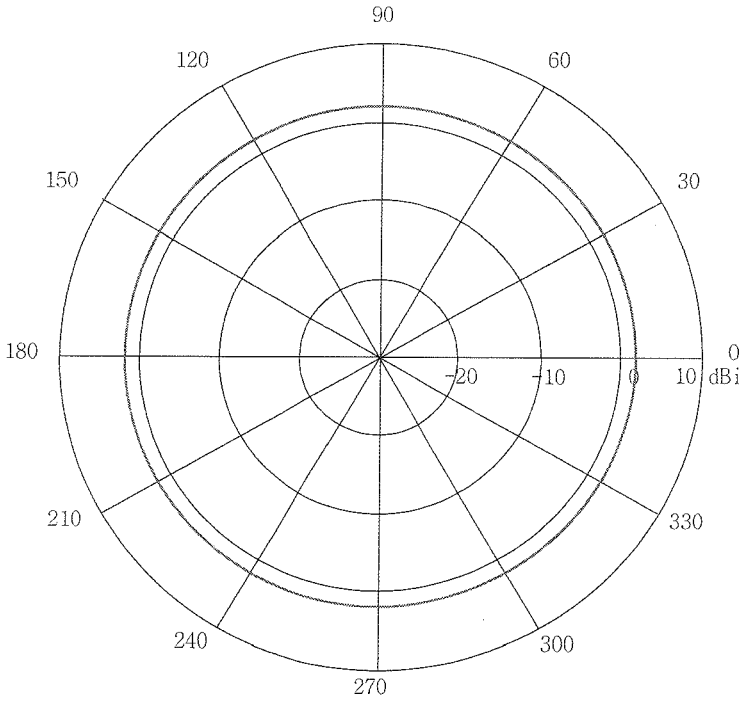

FIGS. 7 and 8 show an electric field pattern of a horizontally polarized wave according to variation of wave angle and azimuth of a small monopole antenna having a loop feeder vertically coupled to a ground plate or PCB in accordance with a preferred embodiment of the present invention.

FIG. 7 shows the electric field pattern of the horizontally polarized element according to the wave angel variation (θ variation, and Φ=90°), and FIG. 8 shows the electric field pattern of the horizontally polarized element according to the azimuth variation (Φ variation, and θ=90°). That is, FIGS. 7 and 8 show that the small monopole antenna according to the present invention has the omni-directional radiation characteristics of the vertically polarized wave as like as the general monopole antenna through the electric field pattern. Herein, the small monopole antenna has a 1.7 dBi gain. If it assumes that the S11 parameter has more loosened condition such as −6 dB, the small monopole antenna has a sufficient bandwidth suitable as an antenna for a personal communication service (PCS) phone, a global system for mobile communication (GSM) phone and a mobile communication terminal. A technology for obtaining a further broadband will be described in later. If the small monopole antenna having the characteristics shown in FIGS. 3 and 4 is installed inside a portable phone, a bandwidth thereof should be further boarded because the Quality Factor becomes lowered by a case, a printer circuit board (PCB) and a cover. Therefore, the small monopoly antenna according to the present invention is suitable for the PCS phone and a GSM phone.

Figure 9:
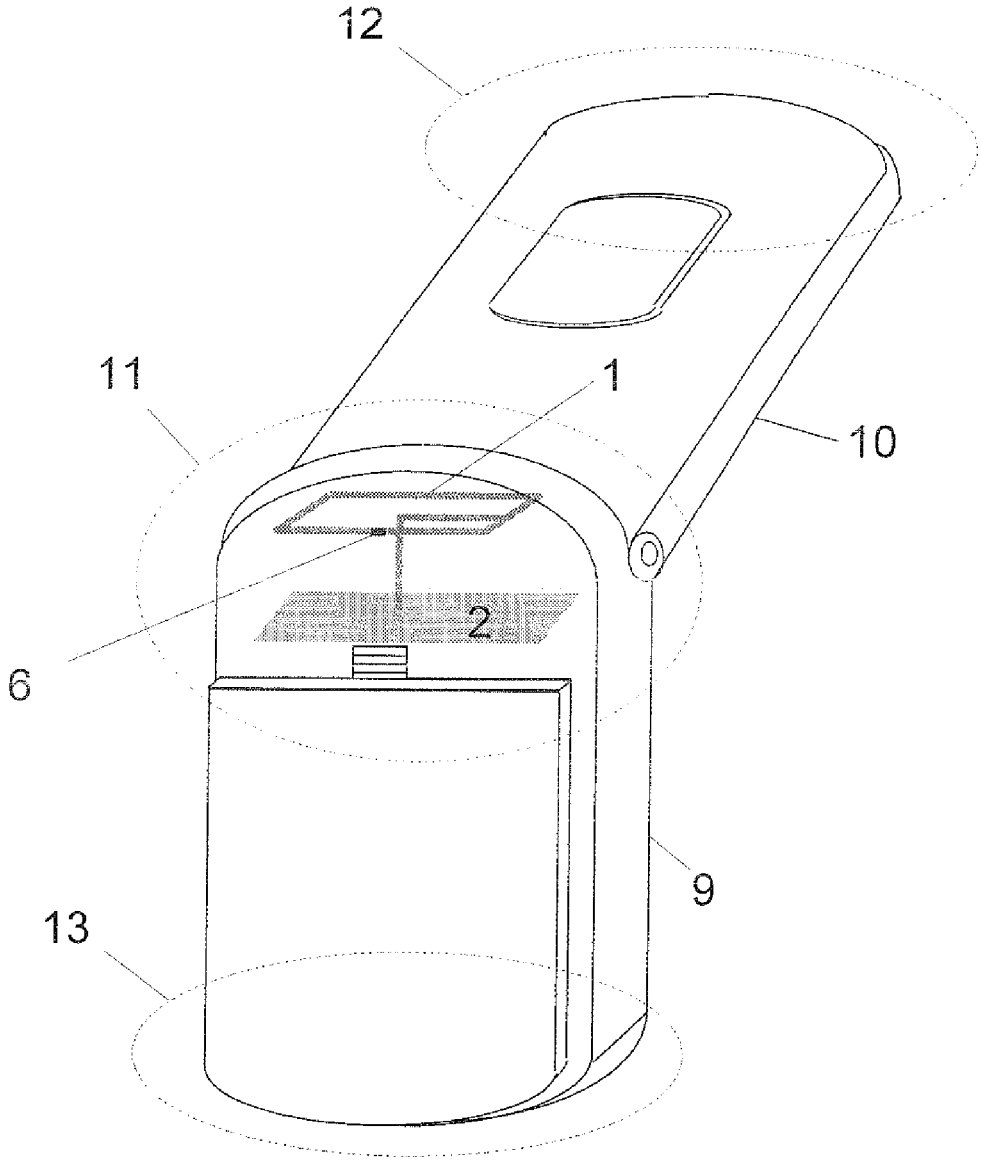
FIG. 9 is a view showing a SAR reducing lowered hinge type wireless communication terminal having a small monopole antenna having a loop feeder vertically coupled to a ground plate in accordance with a preferred embodiment of the present invention.

FIG. 9 is a view showing a SAR reducing lowered hinge type wireless communication terminal having a small monopole antenna having a loop feeder vertically coupled to a ground plate in accordance with a preferred embodiment of the present invention.

FIG. 9 shows the small monopole antenna having a loop feeder vertically coupled to a ground plate embedded in a portable phone introduced in Korean Patent Application No. 10-2001-0043929. As shown in FIG. 9, the shown portable phone has inside spaces suitable for installing an internal antenna such as an upper portion 12 of the covering holder, an upper portion 11 of the main body where is connected to the covering holder and not occupied by the PCB and the battery, and a bottom portion of the main body.

In FIG. 9, the small monopoly antenna having the feeder vertically connected to the ground plate 2 according to the present invention is embedded in the upper portion 11 that connected to the covering holder and is not occupied by the PCB and the battery.

In case of the conventional lowered hinge type portable phone, since the covering holder 10 which influences the antenna characteristics is separated far away from the antenna, the antenna performance is less influenced when the covering holder 10 is opened or closed. Therefore, the antenna may maintain a stable operation. Also, the antenna is separated far away from a head of a user. Therefore, the shown portable phone is suitable to install the internal antenna.

Figure 10:
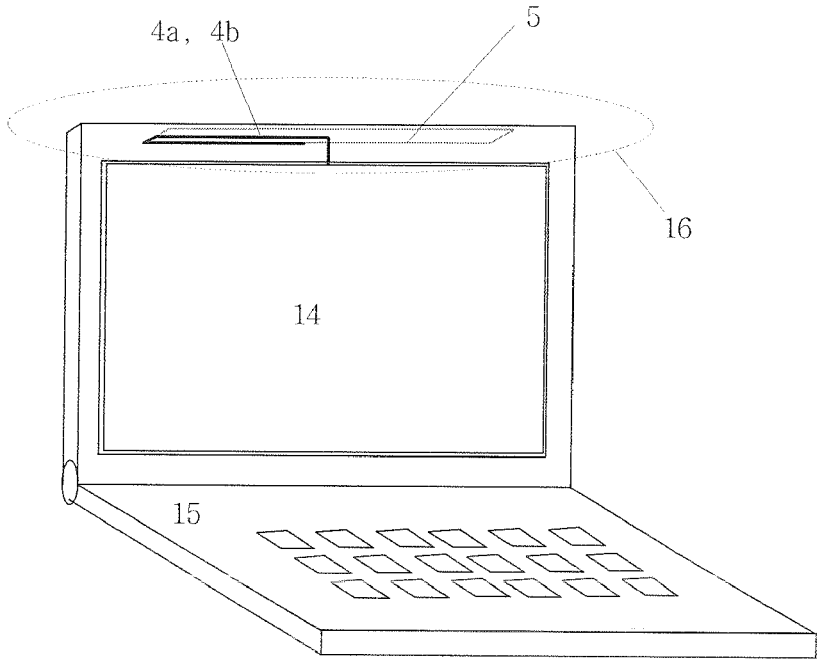
FIGS. 10 and 11 are a front view and a rear view of a notebook computer having a small monopole antenna having a L coupling type feeder in accordance with a preferred embodiment of the present invention.
Figure 11:
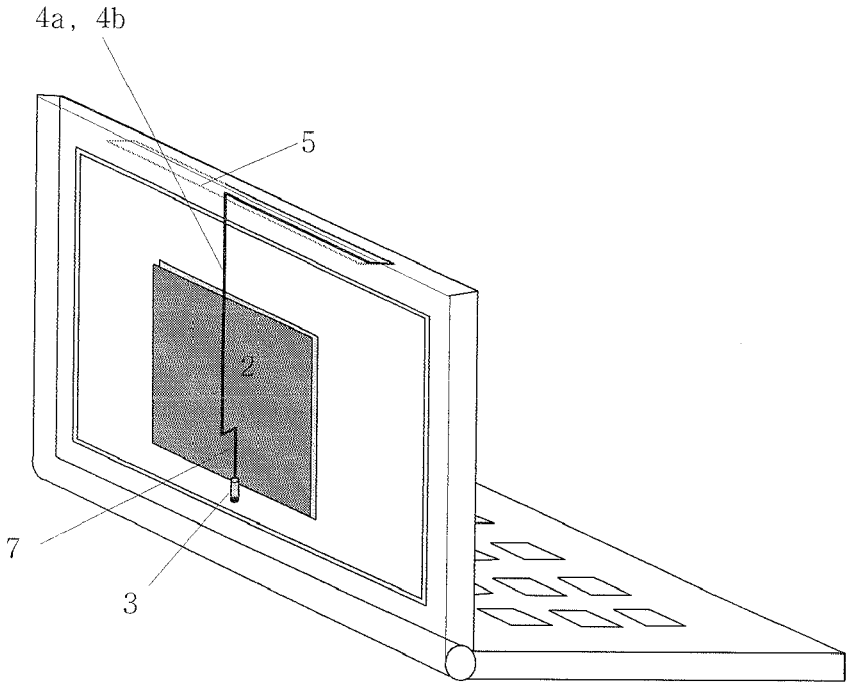

FIGS. 10 and 11 are a front view and a rear view of a notebook computer having a small monopole antenna having an L coupling type feeder in accordance with a preferred embodiment of the present invention.

As shown in FIG. 10, the notebook computer includes a main body 15 and a cover 14, and the notebook computer is generally used with the cover 14 folded in a shape of '∟'. Also, the display unit is generally disposed at the inner surface of the cover 14. The display unit such as a liquid crystal display (LCD) may have electric characteristics similar to conductive material. If the antenna is disposed at the back of the display unit or at the side of the display unit, the radiation efficiency is seriously reduced. Therefore, the antenna should be disposed at an upper portion 16 of the cover 14 as like as the portable phone. However, if the small monopole antenna having a feeder vertically coupled to a ground plate of FIG. 1 is disposed in the notebook computer, the narrow bandwidth problem may occur since the height of the antenna is very low compared to the width of the loop element 1A include in the loop feeder 6. Therefore, it is very difficult to secure a space for installing a vertically disposed portion of a dipole antenna, which is the wire.

However, the problem can be overcome by the small monopole antenna having the L coupling type feeder. FIG. 11 shows the small monopole antenna having a feeder coupled to a ground in an L shape installed at the notebook computer. As shown FIG. 11, the loop feeder 6 of the loop element 1A is disposed at the space 16 where is an upper portion of the display unit in the notebook cover, and the metal ground plate 2 is disposed at the rear of the display unit. Then, the cable and the connector 3 are disposed to connect the metal ground plate 2 and the loop feeder 6. The external conductive member 4A is welded on the ground plate 2. Herein, the ground plate 2 may be allowed to be small. It is because the display unit functions as the ground plate 2 sufficiently. Therefore, the small monopole antenna according to the present invention can be used as an antenna for receiving data of digital multimedia broadcasting (DMB) in 200 MHz in 20 cm×30 cm notebook.

Figure 12:
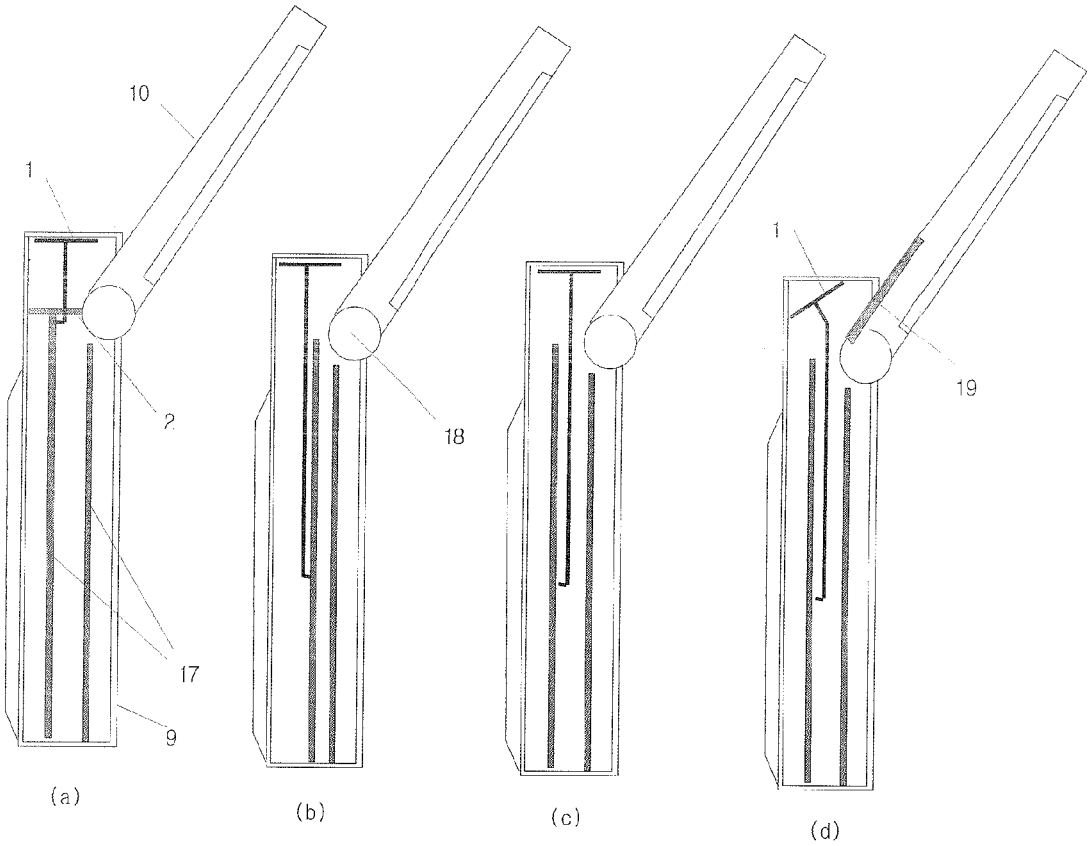
FIG. 12 shows four embodiments of installing a small monopoly antenna having a loop feeder according to the present invention in a SAR reducing lowered hinge type wireless communication terminal.

FIG. 12 shows four embodiments of installing a small monopoly antenna having a loop feeder according to the present invention in a SAR reducing lowered hinge type wireless communication terminal.

A view (a) of FIG. 12 shows a side cross-sectional view of a portable phone having the small monopoly antenna having the loop feeder vertically connected to the ground plate according to the present invention as a first embodiment. As shown, the connector 3 is directly connected to the printed circuit board (PCB).

A view (b) of FIG. 12 shows a side cross-sectional view of a portable phone having the small monopoly antenna having the loop feeder connected to the ground plate in the L shape as a second embodiment of the present invention. The connector 3 is connected at a middle of the PCB. In this case, since a power amplifying unit that is directly connected to an antenna transmitting terminal can be used as a center, the electromagnetic wave source is allowed to be disposed at any desired locations. Therefore, the electromagnetic wave impediment and the introspection problem can be advantageously eliminated, and the antenna can be installed although the space for the antenna is very small.

A view (c) of FIG. 12 shows a side cross-sectional view of a portable phone having the small monopoly antenna having the loop feeder connected to the ground plate in the L shape as a third embodiment of the present invention. As shown, the small monopoly antenna having the loop feeder connected to the ground plate in the L shape is disposed between the printed circuit boards (PCBs). That is, the view (c) shows that the antenna can be differently arranged according to arrangements of the circuits.

A view (d) of FIG. 12 shows a side cross-sectional view of a portable phone having the small monopoly antenna having the loop feeder connected to the ground plate in the L shape as a fourth embodiment of the present invention. As shown, the loop feeder 6 of the loop element 1A is disposed diagonally at the portable phone, and an electromagnetic absorbing member 19 is disposed at the covering folder of the portable phone. Therefore, the electromagnetic (SAR) propagated to the head of the user can be reduced.

That is, if the antenna is disposed at the portable phone as shown in the view (d) in FIG. 12, it is possible to dispose the antenna to be far away from the head of the user. Therefore, the SAR is reduced due to decrement of intensity of the electromagnetic field, and the radiation efficiency of the portable phone can be improved by controlling power ratio consumed at the electromagnetic absorbing member 19 by controlling the horizontal direction of the electromagnetic absorbing member 19 and the polarizing direction of the electric field generated at the antenna.

It is very important to secure a distance from the electromagnetic field absorbing member 19 to the antenna. If the electromagnetic field absorbing member 19 is disposed too close to the antenna in a horizontal direction, the radiation quantity is abruptly decreased due to termination effect. The antenna structure shown in the view (d) in FIG. 12 may be a method of installing the antenna to overcome such a problem because it is possible to dispose the loop element 1A to be far away from the electromagnetic absorbing member 19 in a given space.

Figure 13:
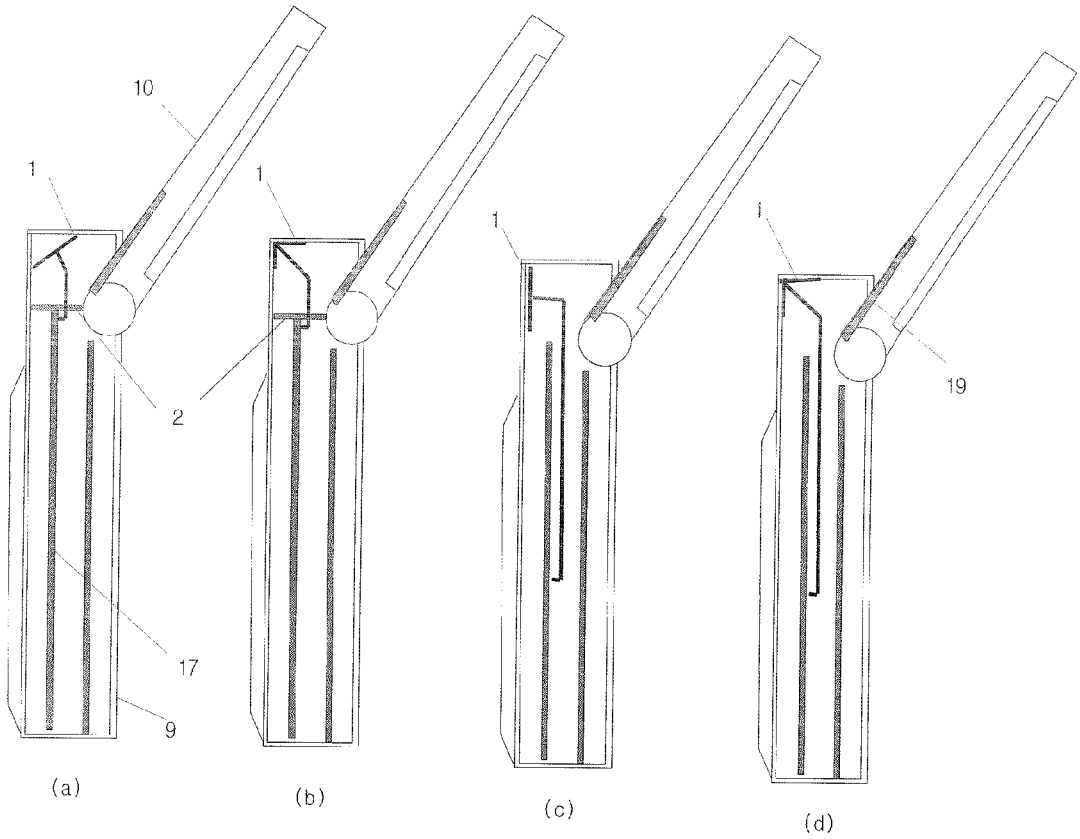
FIG. 13 shows another four embodiments of installing a small monopole antenna having a loop feeder in a SAR reducing lowered hinge type wireless communication terminal in accordance with the present invention.

FIG. 13 shows another four embodiments of installing a small monopole antenna having a loop feeder in a SAR reducing lowered hinge type wireless communication terminal in accordance with the present invention.

A view (a) of FIG. 13 shows a side cross-sectional view of a portable phone having the small monopoly antenna having the loop feeder vertically connected to the ground plate according to a fifth embodiment of the present invention. As shown, an angle formed between the ground plate 2 and the loop plane is about 45°, and it can be embodied to use the monopole antenna having the vertical coupling type loop feeder shown in view (d) in FIG. 12. That is, the loop feeder 6 of the loop element 1A is disposed diagonally to the portable phone, and the electromagnetic absorbing member 19 is disposed at the covering holder of the portable phone. Then, the quantity of electromagnetic wave propagated to the head can be reduced. As described above, it is possible to dispose the antenna to be far away from the head of the user. Therefore, the SAR is reduced due to decrement of intensity of the electromagnetic field, and the radiation efficiency of the portable phone can be improved by controlling power ratio consumed at the electromagnetic absorbing member 19 by controlling the polarizing direction of the electric field generated at the antenna and the horizontal direction of the electromagnetic absorbing member 19.

A view (b) of FIG. 13 shows a side cross-sectional view of a portable phone having the small monopoly antenna having the loop feeder vertically connected to the ground plate according to a sixth embodiment of the present invention. That is, the conductive wire 5 of the loop element 1A is vertically bended as shown in the view (b) of FIG. 13. In this case, the antenna can be disposed at a small space and far away from the head of the user. Therefore, the influence of the antenna impedance can be reduced and the SAR also reduced.

A view (c) of FIG. 13 shows a side cross-sectional view of a portable phone having the small monopoly antenna having the loop feeder connected to the ground plate in the L shape according to a seventh embodiment of the present invention. The loop feeder 6 of the loop element 1A is vertically connected to the printed circuit board (PCB). Such an installing method may be advantageously used when the thickness of the portable phone is very thin.

A view (d) of FIG. 13 shows a side cross-sectional view of a portable phone having the small monopoly antenna having the loop feeder connected to the ground plate in a L shape according to a eighth embodiment of the present invention. As shown, the loop feeder 6 of the loop element 1A is bended at the center thereof. As shown above, the small monopole antenna according to the present invention can be embedded in the portable phone in various shapes of the portable phones.

Figure 14:
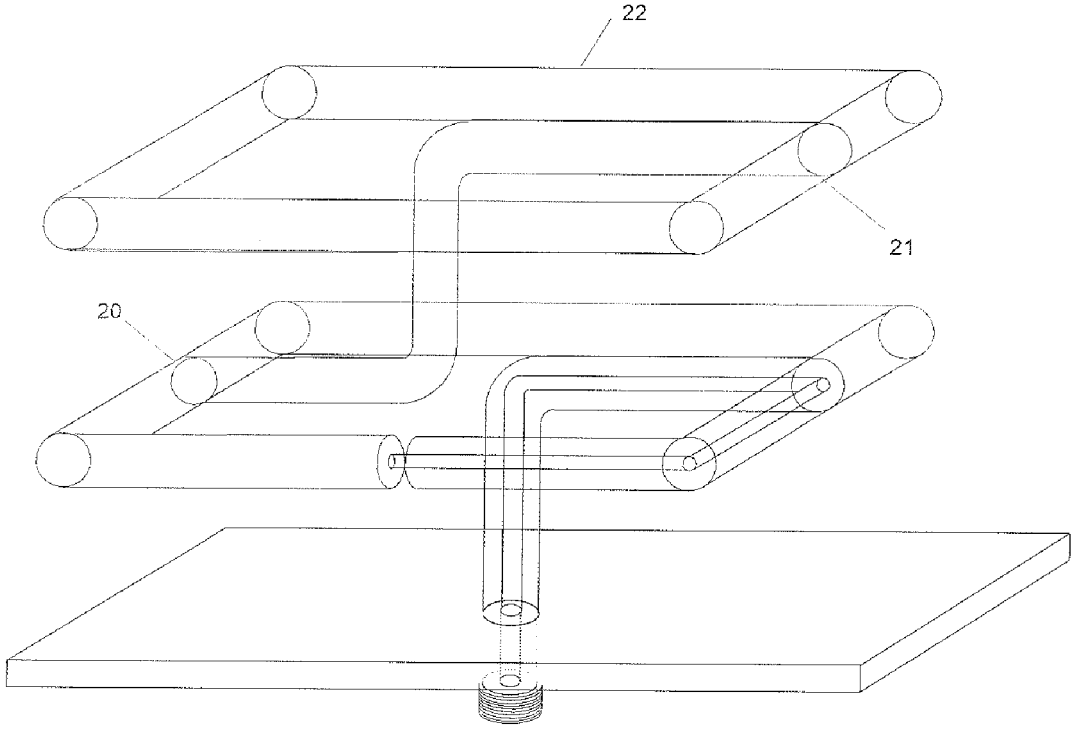
FIG. 14 is a view illustrating a small monopole antenna having a loop feeder having a dual layer structure in accordance with another embodiment of the present invention.

FIG. 14 is a view illustrating a small monopole antenna having a loop feeder having a dual layer structure in accordance with another embodiment of the present invention.

As shown in FIG. 14, since the dual layer structure of the present embodiment secures a further longer electrical length, it is possible to manufacture an antenna for a further lower frequency band in a small space. That is, it is possible to manufacture the antenna further smaller. In FIG. 14, the small monopole antenna has the dual layer structure, but the small monopole antenna according to the present invention may be manufactured to have a plurality of layers such as three, four and five layers.

The small monopole antenna having the loop feeder having the dual layer structure as shown in FIG. 14 can be manufactured as follows. One end of a conductive wire is connected to an opposite side 20 from where the loop element 1*a* and the non-feeding type monopole antenna 1*b* are met, and other end of the conductive wire is connected to a position 21 of a upper loop where is closest to the position of the lower loop where the loop element 1*a* and the non-feeding type monopole antenna 1*b* are met. Multiple layers antenna can be manufactured to repeatedly connecting loops as described above. Such a structure allows the antenna having less than 1/20 wavelength to be manufactured. The dual layer structure can be identically applied to the small monopole antenna having the loop feeder connected to the ground plate in the L shape.

Figure 15:
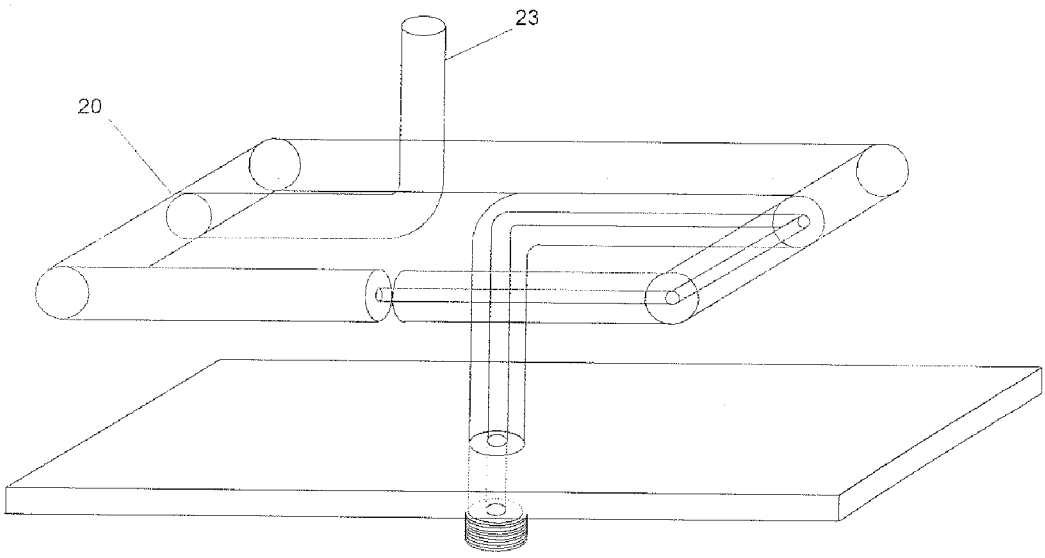
FIG. 15 is a view illustrating a small monopole antenna having a loop feeder having a tail member in accordance with another embodiment of the present invention.

FIG. 15 is a view illustrating a small monopole antenna having a loop feeder having a tail member in accordance with another embodiment of the present invention.

The dual structured small monopole antenna of FIG. 14 can be manufactured to have the tail member as shown in FIG. 10. If the tail member 23 is disposed, the electrical length is lengthened to generate a low frequency lower than a resonant frequency. Therefore, the antenna can be manufactured as very small.

As shown in FIG. 15, in the small monopole antenna having a loop feeder according to the present invention, the tail member 23 is disposed to face internally to the loop element 1*a* and bended at the center of the loop. The bended end of the tail member 23 is connected to the opposite side of the loop element 1*a* from where the loop element 1*a* is connected to the ground plate 2.

Such a tail member 23 may be embodied in various shapes. The tail member 23 may be disposed at out side of the loop. That is, the tail member 23 may be disposed in any direction.

The tail member 23 may be used to tune the antenna. That is, the length of the tail member 23 is controlled to tune the antenna to have a desired characteristic. If the antenna having the tail member 23 is installed in the portable phone, it is possible to reduce time for tuning. Therefore, the manufacturing time thereof also can be reduced. The tail member 23 may be identically applied to the small monopole antenna having the loop feeder coupled to the ground plate in the L shape.

Figure 16:
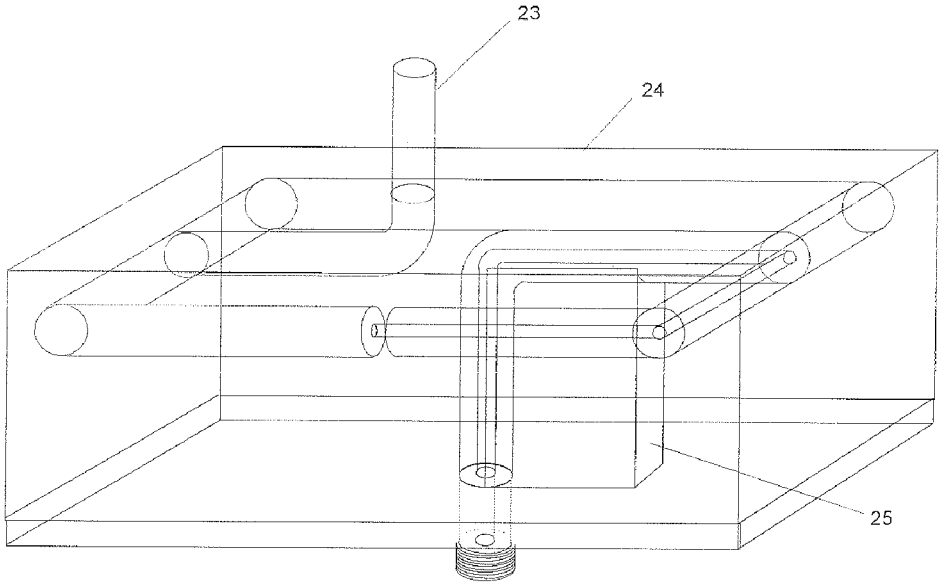
FIG. 16 shows a small monopole antenna having a loop feeder integrally formed with a tail member and a dielectric member in accordance with a preferred embodiment of the present invention.

FIG. 16 shows a small monopole antenna having a loop feeder integrally formed with a tail member and a dielectric member in accordance with a preferred embodiment of the present invention.

As shown in FIG. 16, the predetermined portion of the tail member 23 is projected out of the dielectric member, and the loop element 1A is only disposed inside the dielectric member 24.

As shown in FIG. 16, it is possible to make the antenna further smaller as like as a general dielectric antenna when the dielectric member is used. In this case, the antenna may have a narrowband characteristic. In order to eliminate the narrowband characteristic, the metal plate 25 is connected to an antenna connected to the ground plate in the present embodiment of FIG. 16. In this case, the broadband characteristics can be obtained because the electrical length is lengthened by connecting the metal plate 25. Furthermore, the broadband characteristics can be obtained by forming the non-feeding type monopole antenna 1*b* thicker than the loop element 1*a*. It is possible to apply the dielectric member 24 and the metal pin 25 into the above described embodiments of the present invention to obtain the identical electrical characteristics.

Figure 17:
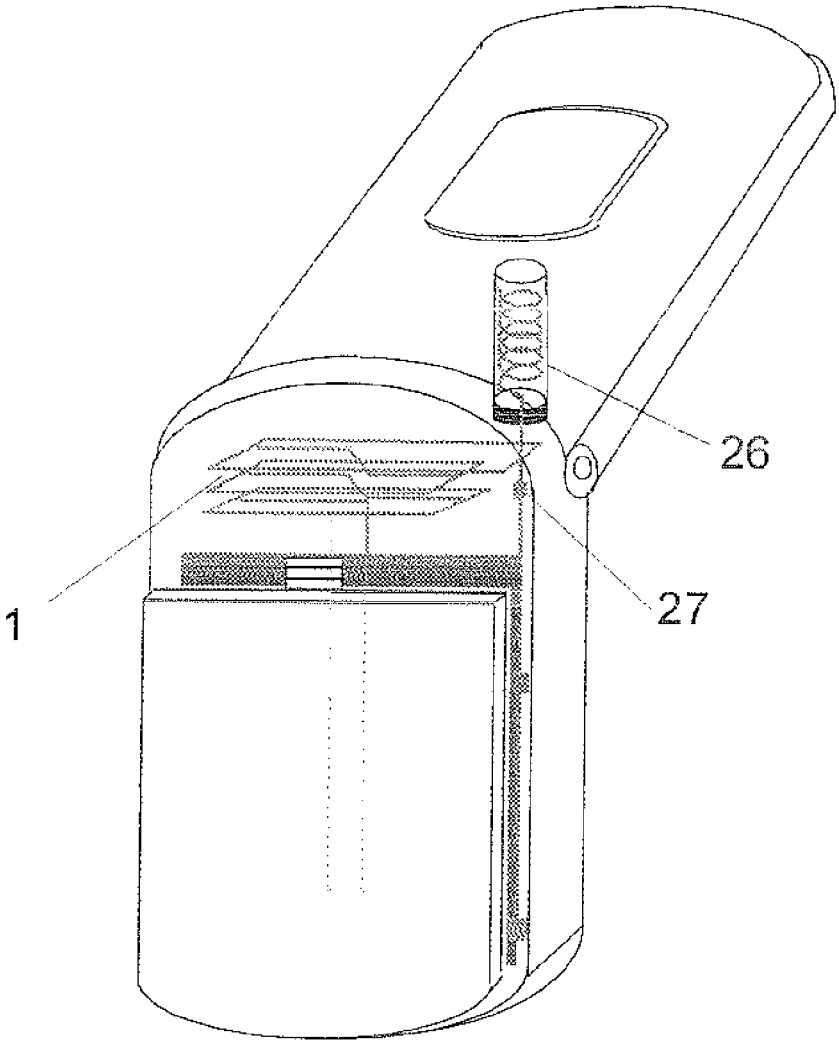
FIGS. 17 to 19 show wireless communication terminals having a small monopole antenna having a loop feeder in accordance with a preferred embodiment of the present invention.
Figure 18:
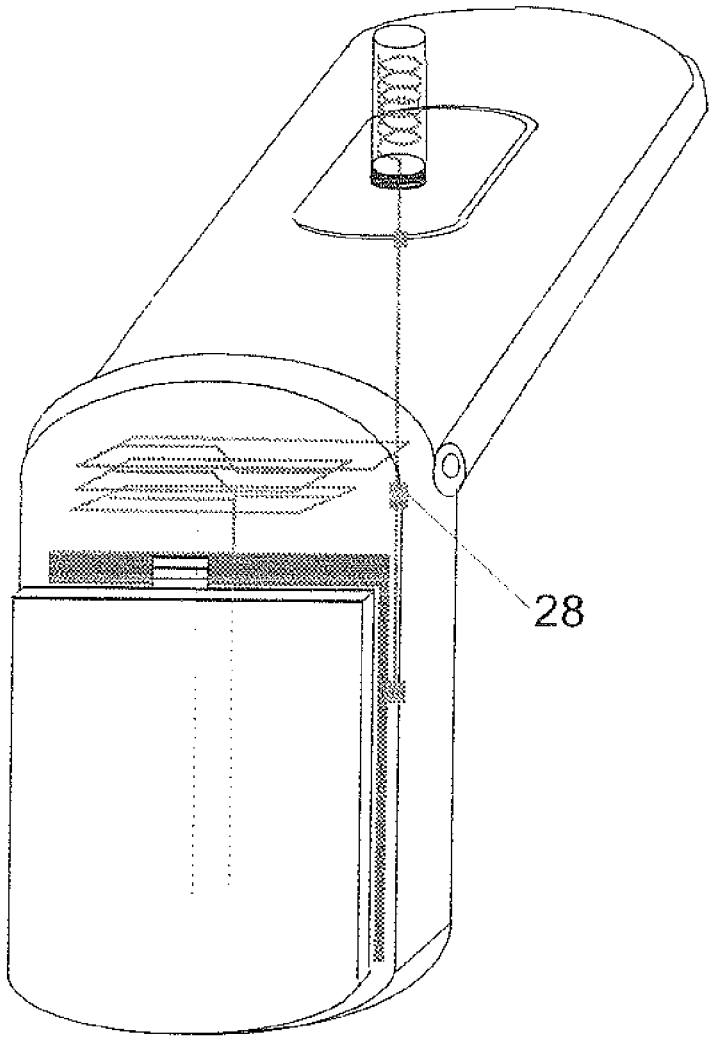
Figure 19:
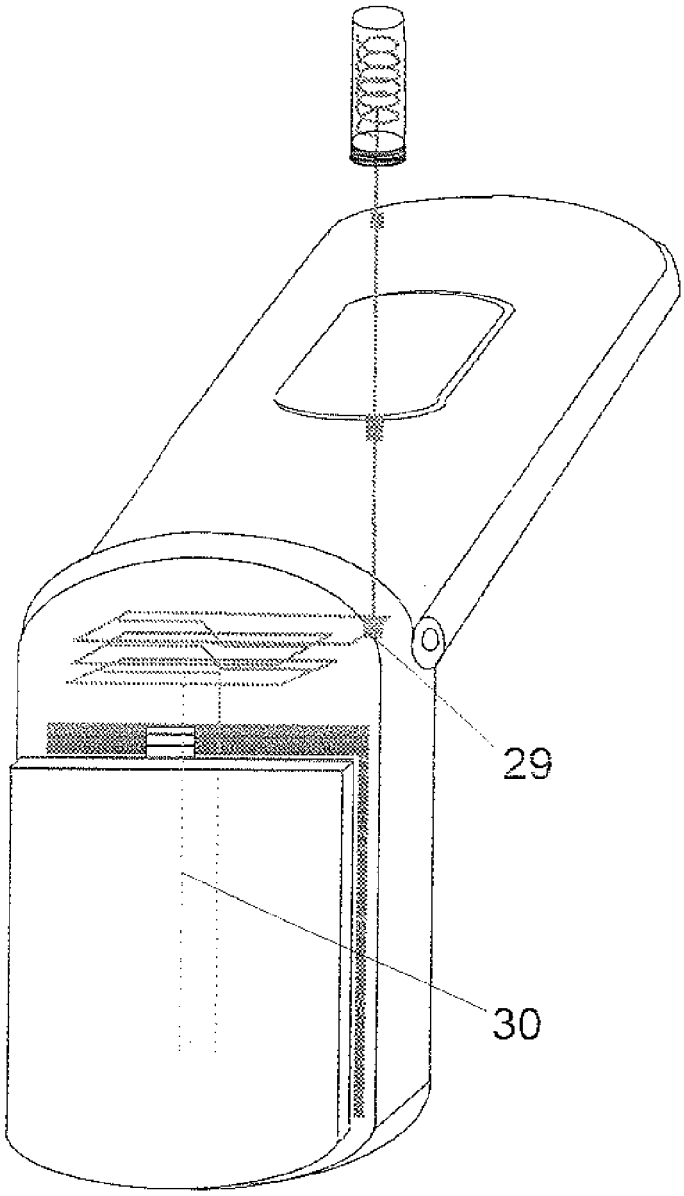

FIGS. 17 to 19 show wireless communication terminals having a small monopole antenna having a loop feeder in accordance with a preferred embodiment of the present invention.

FIGS. 17 to 19 show embodying of an antenna for different frequency band and providing various wireless services using a small monopole antenna having a loop feeder in accordance with a preferred embodiment of the present invention. The small monopole antenna having a loop feeder according to the present invention generate a vertically polarized wave because the polarizing direction is vertical, and it is possible to use with a whip antenna, a helical antenna and a conical antenna which are an antenna having a loop feeder at the bottom thereof.

FIG. 17 shows a shape of an antenna of a personal potable phone for an operating frequency in a range of 1.8 GHz to 2.6 GHz which is a China DMB phone or a PCS phone. That is, the helical antenna or a whips antenna 26 is controlled to generate a resonant frequency in a frequency of a personal portable phone. Herein, the small monopole antenna is not connected to the helical antenna or the whips antenna 26. In order to operate the helical antenna or the whip antenna only, a feeder 27 is disposed to be close to the helical antenna or the whips antenna.

FIG. 18 shows a shape of an antenna for a cellular mobile communication terminal operated in the operating frequency of the cellular mobile communication terminal or a radio frequency identification (RFID) terminal. Since the frequency band of the cellular mobile communication or the RFID terminal which is about 900 MHz band is lower than that of the personal communication service (PCS) terminal which is about 1.8 GHz band, the cellular mobile communication terminal requires a longer antenna than the PCS terminal. Therefore, the loop feeder 28 is disposed at a position corresponding to length of "whip antenna+helical antenna" for the cellular service. That is, the antenna of FIG. 17 becomes the antenna for the frequency band of the RFID terminal or the cellular mobile communication terminal if the helical antenna is pulled out at half of it's length as shown in FIG. 18.

FIG. 19 shows a shape of an antenna for a Korea DMB wireless communication terminal operated in the operating frequency of the Korea DMB wireless communication terminal which is 200 MHz band. That is, if the helical antenna and whip antenna 26 are pulled out at it's full length, the small monopole antenna, the helical antenna and whip antenna 26 becomes in one line. Herein, if the loop feeder 6 of the small monopole antenna is used at a feeding point, the size of the antenna will be set further longer. In this case, the antenna would have a higher receiving sensitivity compared to the antenna embodied with a dual layer antenna and be suitable for receiving a terrestrial DMB data.

In order to obtain broadband characteristics, a line element 30 may be disposed to connect the external conductive member 4A of the coaxial cable to the ground plate 2 for lengthening the electric length. It is possible to dispose more than one line element and the broader broadband characteristics may be obtained compared to the antenna without the line element.

As described above, it is possible to manufacture a hybrid antenna for multi-type portable phone as shown in FIGS. 17 to 19. As an embodiment, a low frequency band antenna can be manufactured as like as a stubby type terrestrial DMB antenna by connecting a small monopole antenna having a loop feeder to a helical antenna. Herein, the loop feeder 6 may be movably disposed from an upper layer of a dual layer structure to a center thereof for impedance matching.

In order to further lengthen the electric length, a portion connecting the external conductive member 4*a* of the coaxial cable to the ground plate 2 is formed as a meander type or as a twisted shape as like as a helical shape. In this case, the electric length can be lengthened further than the using of the line element 30. Therefore, the size of the antenna can be reduced by inducing the resonance in low frequency band.

In FIGS. 17 to 19, it is possible to connect three antennas by pulling up the whip antenna with the helical antenna fixed. In this case, the inconvenience of using a portable phone with an antenna may be diminished because the helical antenna is not placed to the top of the whip antenna. Although the helical antenna is not placed on the top of the whip antenna, it would have the identical polarizing direction of a radiation electric wave. Therefore, the identical effect shown in FIGS. 17 to 19 can be obtained.

While the present invention has been described with respect to certain preferred embodiments, it will be apparent to those skilled in the art that various changes and modifications may be made without departing from the scope of the invention as defined in the following claims.

What is claimed is:

1. A small monopole antenna having a loop feeder comprising:

a loop element forming a loop along a predetermined plane and having a loop feeder at the center thereof;

a non-feeding type monopole antenna element including one end connected to a wire of the loop element and other end connected to a ground means by being bended at the center of the loop element;

a ground means for grounding other end of the non-feeding type monopole antenna; and a first connecting means for connecting the non-feeding type monopole antenna to an external device for feeding the loop feeder of the loop element through the non-feeding type monopole antenna.

2. The small monopole antenna as recited in claim 1, wherein the loop element and the ground means are disposed to vertically arrange the loop plane of the loop element and the ground plane of the ground means.

3. The small monopole antenna as recited in claim 1, wherein the loop element and the ground means are disposed to horizontally arrange the loop plane of the loop element and the ground plane of the ground means.

4. The small monopole antenna as recited in claim 1 wherein an angle formed between the loop plane and the ground plane of the ground means is in a range of −45° to 45° from the loop plane of the loop element or from a vertical plane of the loop plane.

5. The small monopole antenna as recited in claim 1, further comprising one or more wires for connecting the loop element and the ground means.

6. The small monopole antenna as recited in claim 1, further comprising a metal plate attached at the non-feeding type monopole antenna element between the loop element and the ground means.

7. The small monopole antenna as recited in claim 1, wherein the non-feeding type monopole antenna element includes one end connected to the loop element and other end connected to the ground means without including a feeder for feeding power, where an outer cover of a wire composing the non-feeding type monopole antenna element is connected to a ground plane of the ground means.

8. The small monopole antenna as recited in claim 1, wherein the non-feeding type antenna element is thicker than the loop element.

9. The small monopole antenna as recited in claim 1, wherein the wire composing the non-feeding type monopole antenna is a meander type.

10. The small monopole antenna as recited in claim 1, wherein the wire composing the non-feeding type monopole antenna is twisted as a helical shape.

11. The small monopole antenna as recited in claim 1, further comprising:

a plurality of elements each forming a loop having a feeder at a center thereof and formed above the loop element in parallel sequentially; and a plurality of second connecting means for connecting the loop element and the elements which form a loop and is formed above the loop elements, wherein more than two loops are formed to form a dual layer structure.

12. The small monopole antenna as recited in claim 1, wherein the loop element includes a tail member.

13. The small monopole antenna as recited in claim 12, wherein the tail member is disposed to face the inside of the loop element, bended at the center of the loop element toward the opposite direction of the ground means, and attached at a predetermined position opposite from where the ground means and the loop element are connected.

14. The small monopole antenna as recited in claim 12, wherein the tail member is disposed at the outside of the loop.

15. The small monopole antenna as recited in claim 12, wherein the tail member is disposed to be projected to the out of a dielectric member where the loop element is installed.

16. The small monopole antenna as recited in claim 1, wherein the small monopole antenna is used by being connected to one or more of a helical antenna, a conical antenna and a whips antenna which are an antenna having a feeder disposed under the antenna.

17. The small monopole antenna as recited in claim 1, wherein the small monopole antenna includes a helical antenna connected to an opposite side from where the loop element and the non-feeding monopole antenna element are connected.

18. The small monopole antenna as recited in claim 17, wherein the small monopole antenna is manufactured to be operated by being separated from the helical antenna.

19. The small monopole antenna as recited in claim 1, wherein the small monopole antenna is operated by being connected to a whips antenna at an opposite side from where the loop element and the non-feeding monopole antenna element are connected, and a helical antenna is connected to an end portion of the whips antenna.

20. The small monopole antenna as recited in claim 1, wherein the small monopole antenna is operated by being connected to a helical antenna at an opposite side from where the loop element and the non-feeding monopole antenna element are connected, and a whips antenna is connected to an end portion of the whips antenna.

21. The small monopole antenna as recited in claim 1, wherein the small monopole antenna is disposed inside a wireless communication terminal with the loop plane of the loop element diagonally disposed from a printed circuit board of the wireless communication terminal.

22. The small monopole antenna as recited in claim 1, wherein the small monopole antenna is disposed inside a wireless communication terminal with the loop plane of the loop element disposed in parallel from a printed circuit board of the wireless communication terminal.

23. The small monopole antenna as recited in claim 1, wherein the small monopole antenna is disposed inside a wireless communication terminal with the loop plane of the loop element bended at the center of the loop element to have two sides orthogonally crossing one another.

24. The small monopole antenna as recited in claim 1, further comprising a tail member, wherein a predetermined portion of the small monopole antenna is integrally manufactured with the dielectric substance.

* * * * *